US007263426B2

(12) United States Patent
Withrow et al.

(10) Patent No.: US 7,263,426 B2
(45) Date of Patent: Aug. 28, 2007

(54) SYSTEM FOR CONTROLLING FUEL DELIVERY AT ALTITUDE

(75) Inventors: Michael P. Withrow, Peoria, IL (US); Michael S. Bond, Chillicothe, IL (US); Clayton D. Walenta, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 11/261,572

(22) Filed: Oct. 31, 2005

(65) Prior Publication Data

US 2007/0100536 A1 May 3, 2007

(51) Int. Cl.
*F02D 41/40* (2006.01)
*F02D 43/04* (2006.01)

(52) U.S. Cl. ..... 701/104; 701/115; 123/350; 123/357

(58) Field of Classification Search ..... 701/101, 701/103, 104, 110, 115; 123/350, 357
See application file for complete search history.

(56) References Cited

U.S. PATENT DOCUMENTS 3,652,065 A 3/1972 Casey et al.
4,368,705 A 1/1983 Stevenson et al.
4,428,354 A 1/1984 Sundeen et al.
4,572,132 A 2/1986 Piwonka
4,633,842 A 1/1987 Ikeda et al.
5,481,462 A 1/1996 Nagai
5,839,416 A * 11/1998 Kruiswyk et al. ..... 123/559.2
6,158,416 A 12/2000 Chen et al.
6,286,480 B1 9/2001 Chen et al.
6,493,627 B1 * 12/2002 Gallagher et al. ..... 701/104

FOREIGN PATENT DOCUMENTS

JP 57131823 8/1982
JP 9-177593 7/1997
JP 2001-207897 8/2001

* cited by examiner

*Primary Examiner*—Johnny N. Hoang
(74) *Attorney, Agent, or Firm*—Finnegan, Henderson, Farabow, Garrett & Dunner L.L.P.

(57) ABSTRACT

A control system for an engine having a combustion chamber is disclosed. The control system has a first sensor, a second sensor, and a third sensor. The first sensor generates a signal indicative of ambient air pressure. The second sensor generates a signal indicative of the pressure of air entering the combustion chamber. The third sensor generates a signal indicative of a speed of the engine. The control system also has a controller configured to reference a first map to determine a first fuel limit value based on the pressure of air entering the combustion chamber and the speed of the engine, reference a second map to determine a second fuel limit value based on the pressure of air entering the combustion chamber and the speed of the engine, and determine a third fuel limit value based on the first and second fuel limit values and the ambient air pressure.

20 Claims, 3 Drawing Sheets

SYSTEM FOR CONTROLLING FUEL DELIVERY AT ALTITUDE

TECHNICAL FIELD

The present disclosure is directed to a fuel system and, more particularly, to a fuel system for controlling fuel delivery to an engine at altitude.

BACKGROUND

Internal combustion engines, including diesel engines, gasoline engines, gaseous-fueled engines, and other engines known in the art, may exhaust a complex mixture of air pollutants. These air pollutants may be composed of gaseous compounds and solid particulate matter. Solid particulate matter may be recognized as soot entrained within black smoke emitted from the engine. Due to increased attention on the environment, exhaust emission standards have become more stringent and the amount of black smoke emitted from an engine may be regulated depending on the type of engine, size of engine, and/or class of engine.

It has been established that the amount of fuel available for combustion relative to the amount of air simultaneously available (fuel to air equivalence ratio), is directly related to the amount of black smoke produced and emitted from an engine following combustion of the fuel/air mixture. For example, a higher fuel to air equivalence ratio will result in a greater production of smoke, while a lower fuel to air equivalence ratio will result in a lower production of smoke. For this reason, a vehicle that meets black smoke regulations at sea level may fail to meet the same regulations at altitude, because of the decreasing atmospheric air density at altitude.

One method that has been implemented by engine manufacturers to meet black smoke regulations at altitude has been to limit fuel delivery to the engine according to altitude. One such method is described in U.S. Pat. No. 4,368,705 (the '705 patent) issued to Stevenson et al. on Jan. 18, 1983. The '705 patent describes an electronic engine control system having a plurality of engine maps. During operation of an engine, the electronic engine control system references a first map to determine a maximum fuel/air ratio for sufficient combustion to meet emission standards as a function of current engine speed. The maximum fuel/air ratio is then supplied to a multiplier along with a current intake manifold air pressure to determine a maximum amount of allowable fuel to be injected per engine stroke. The electronic engine control system then references current ambient air pressure with a second map to retrieve an altitude derating multiplier, and applies the derating multiplier to decrease the maximum amount of allowable fuel. This decreased maximum amount of allowable fuel is then used to limit the amount of fuel introduced to the engine during a single stroke of the engine such that black smoke production at varying altitudes may be reduced.

Although the electronic engine control system of the '705 patent may reduce black smoke production at altitude, it may be limited and inefficient. In particular, because the altitude derating multiplier is only based on ambient air pressure and does not vary according to any other engine parameters, it may inaccurately control the production of smoke throughout the operational range of the engine. For the same reason, the electronic control system of the '705 patent may unnecessarily limit some portions of the engine's operational range, resulting in inefficient operation.

The control system of the present disclosure solves one or more of the problems set forth above.

SUMMARY OF THE INVENTION

One aspect of the present disclosure is directed to control system for an engine having a combustion chamber. The control system includes a first sensor, a second sensor, and a third sensor. The first sensor is configured to generate a signal indicative of ambient air pressure. The second sensor is configured to generate a signal indicative of the pressure of air entering the combustion chamber. The third sensor is configured to generate a signal indicative of a speed of the engine. The control system also includes a controller in communication with the first, second, and third sensors. The controller is configured to reference a first map stored in a memory of the controller to determine a first fuel limit value based on the pressure of air entering the combustion chamber and the speed of the engine, to reference a second map stored in a memory of the controller to determine a second fuel limit value based on the pressure of air entering the combustion chamber and the speed of the engine, and to determine a third fuel limit value based on the first and second fuel limit values and the ambient air pressure.

In another aspect, the present disclosure is directed to a method of controlling an engine having a combustion chamber. The method includes sensing an ambient air pressure, sensing a pressure of air entering the combustion chamber, and sensing a speed of the engine. The method also includes determining a first fuel limit value based on the pressure of air entering the combustion chamber and the speed of the engine, determining a second fuel limit value based on the pressure of air entering the combustion chamber and the speed of the engine, and determining a third fuel limit value based on the first and second fuel limit values and the ambient air pressure.

DETAILED DESCRIPTION

Figure 1:
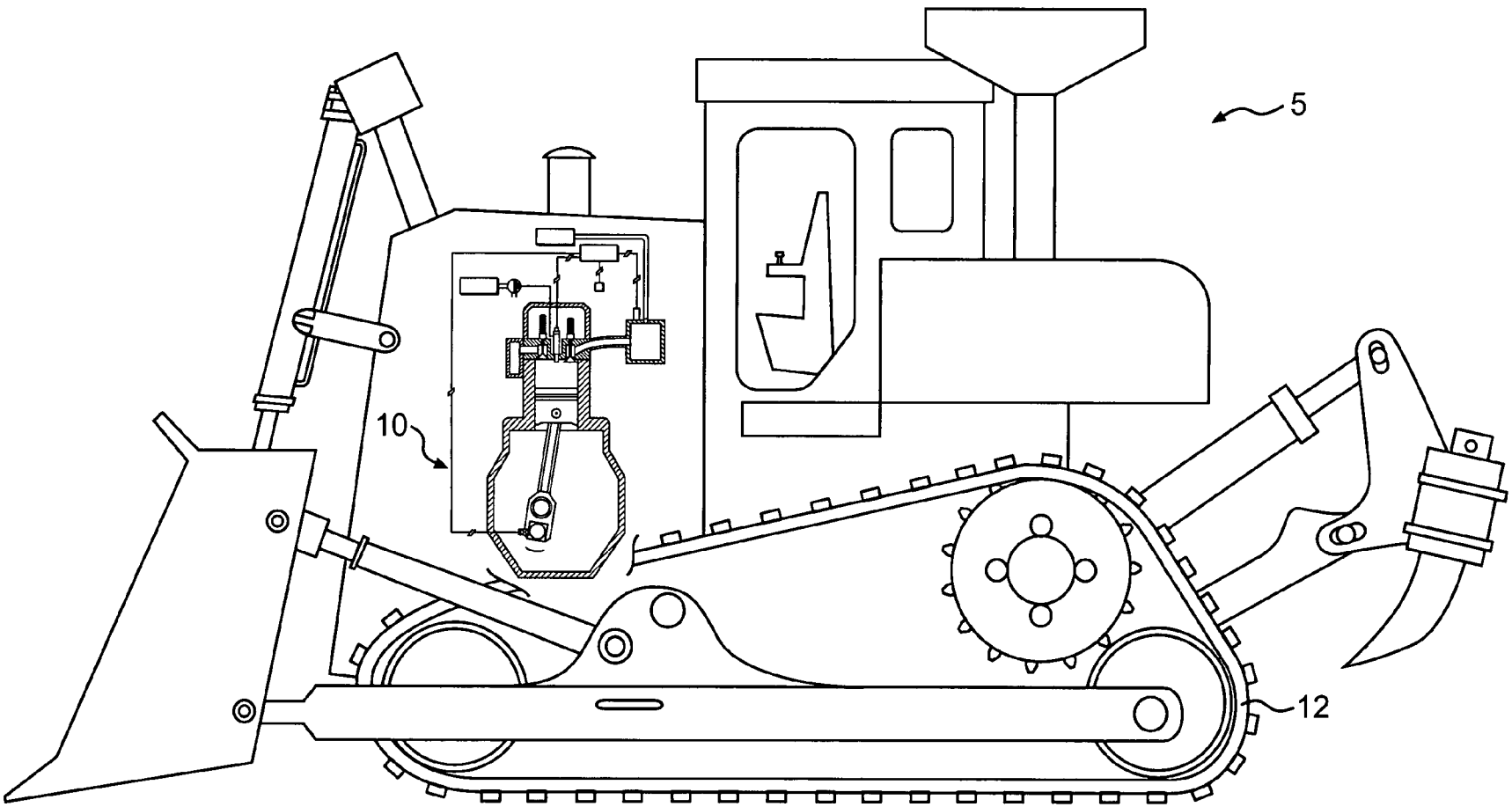
FIG. 1 is a diagrammatic illustration of an exemplary disclosed work machine.

FIG. 1 illustrates a work machine 5 having an exemplary internal combustion engine 10. Work machine 5 may embody a stationary machine or mobile machine having a traction device 12, and may perform some type of operation associated with an industry such as mining, construction, farming, transportation, power generation, or any other industry known in the art. For example, work machine 5 may embody an earth moving machine such as a dozer, a loader, a backhoe, an excavator, a motor grader, a dump truck, or any other earth moving machine. Work machine 5 may alternatively embody a stationary generator set, pumping mechanism, or any other suitable operation-performing work machine.

Figure 2:
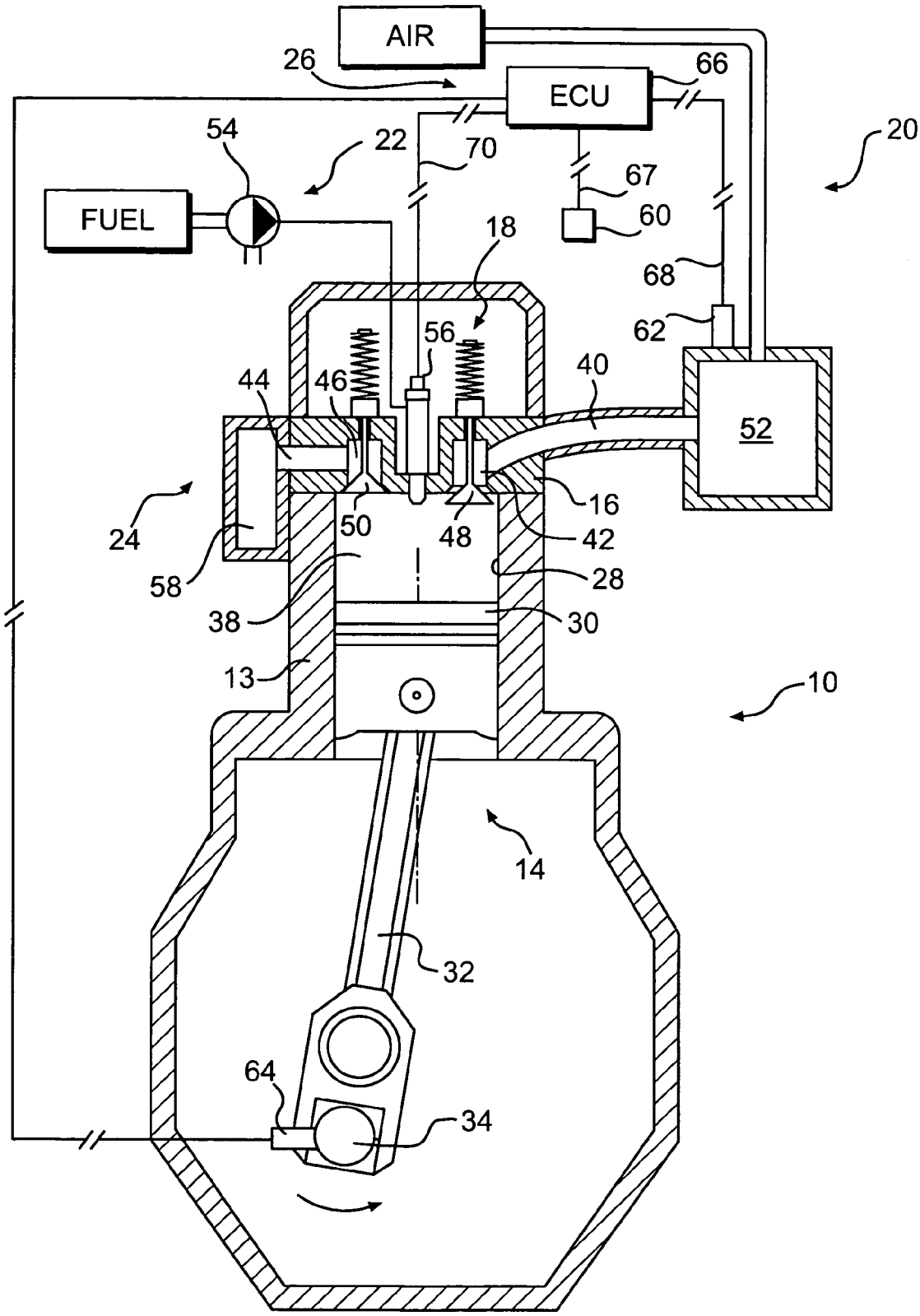
FIG. 2 is a schematic and diagrammatic illustration of an internal combustion engine for the work machine of FIG. 1.

Internal combustion engine 10 is depicted in FIG. 2 and described herein as a diesel-fueled internal combustion engine 10. However, it is contemplated that internal combustion engine 10 may embody any other type of internal combustion engine, such as, for example, a gasoline or gaseous fuel-powered engine. Internal combustion engine 10 may include an engine block 13, a plurality of piston assemblies 14 (only one shown in FIG. 2), a cylinder head 16 associated with each piston assembly 14, a valve actuation system 18, an air induction system 20, a fuel system 22, an exhaust system 24, and a control system 26.

Engine block 13 may embody a central structure defining a plurality of cylinders 28 (only one shown in FIG. 2). One of piston assemblies 14 may be slidably disposed within each of cylinders 28. It is contemplated that internal combustion engine 10 may include any number of cylinders 28 and that cylinders 28 may be disposed in an "in-line" configuration, a "V" configuration, or any other conventional configuration.

Each piston assembly 14 may be configured to reciprocate between a bottom-dead-center (BDC) position, or lowermost position within cylinder 28, and a top-dead-center (TDC) position, or upper-most position within cylinder 28. In particular, piston assembly 14 may include a piston crown 30 pivotally coupled to a connecting rod 32, which is in turn pivotally coupled to a crankshaft 34. Crankshaft 34 of internal combustion engine 10 may be rotatably disposed within engine block 13 and each piston assembly 14 coupled to crankshaft 34 such that a sliding motion of each piston assembly 14 within each cylinder 28 results in a rotation of crankshaft 34. Similarly, a rotation of crankshaft 34 may result in a sliding motion of piston assemblies 14. As crankshaft 34 rotates 180 degrees, piston crown 30 and linked connecting rod 32 may move through one full stroke between BDC and TDC. Internal combustion engine 10 may embody a four stroke (e.g., four cycle) engine, wherein a complete cycle includes an intake stroke (TDC to BDC), a compression stroke (BDC to TDC), a power stroke (TDC to BDC), and an exhaust stroke (BDC to TDC). It is also contemplated that internal combustion engine 10 may alternatively embody a two stroke (e.g., two cycle) engine, wherein a complete cycle includes a compression/exhaust stroke (BDC to TDC) and a power/exhaust/intake stroke (TDC to BDC).

Each cylinder head 16 may be associated with one cylinder 28 to form a combustion chamber 38 having one or more fluid ports. Specifically, cylinder head 16 may define an intake passageway 40 that leads to an intake port 42 for each cylinder 28. Cylinder head 16 may further define at least one exhaust passageway 44 that leads to an exhaust port 46 for each cylinder 28. It is contemplated that one cylinder head 16 may alternatively be associated with multiple cylinders 28 and piston assemblies 14 to form multiple combustion chambers. It is also contemplated that cylinder head 16 may further define two or more intake ports 42 and/or exhaust ports 46 for each cylinder 28.

Valve actuation system 18 may include an intake valve 48 disposed within each intake port 42. Each intake valve 48 may include a valve element that is configured to selectively block the respective intake port 42. Each intake valve 48 may be actuated to move or "lift" the valve element to thereby open the respective intake port 42. In a cylinder 28 having a pair of intake ports 42 and a pair of intake valves 48, the pair of intake valves 48 may be actuated by a single valve actuator (not shown) or by a pair of valve actuators (not shown).

An exhaust valve 50 may be disposed within each exhaust port 46. Each exhaust valve 50 may include a valve element that is configured to selectively block the respective exhaust port 46. Each exhaust valve 50 may be actuated to move or "lift" the valve element to thereby open the respective exhaust port 46. In a cylinder 28 having a pair of exhaust ports 46 and a pair of exhaust valves 50, the pair of exhaust valves 50 may be actuated by a single valve actuator (not shown) or by a pair of valve actuators (not shown).

Air induction system 20 may be configured to draw or force air into internal combustion engine 10 and may include an intake manifold 52 fluidly connected with intake passageway 40. It is contemplated that air induction system 20 may embody a charged air system having a turbine-driven or engine-driven compressor (not shown) and may include additional air handling components such as, for example, a wastegate, a throttle valve, an EGR system, an air cleaner, an air cooler, or any other air handling component known in the art. The pressure of the air within intake manifold 52 during the intake stroke of piston assembly 14 may affect the amount of air drawn into combustion chamber 38 and the resulting fuel to air equivalence ratio.

Fuel system 22 may be configured to supply fuel to internal combustion engine 10 and may include a source of pressurized fuel 54 and at least one fuel injector 56. It is contemplated that additional components may be included within fuel system 22 such as for example, a supply or relief valve mechanism, a common fuel rail to simultaneously distribute fuel to multiple fuel injectors, a pre-combustion chamber, a filtering device, or any other fuel system component known in the art.

Source of pressurized fuel 54 may be configured to produce a flow of pressurized fluid and may include at least one pump such as, for example, a variable displacement pump, a fixed displacement pump, a variable flow pump, or any other source of pressurized fluid known in the art. Source of pressurized fuel 54 may be drivably connected to internal combustion engine 10 by, for example, a countershaft (not shown), a belt (not shown), an electrical circuit (not shown), or in any other suitable manner.

Each of fuel injectors 56 may be disposed within cylinder head 16 associated with each cylinder 28. Fuel injectors 56 may be operable to inject a predetermined amount of pressurized fuel into combustion chamber 38 at predetermined fuel pressures and fuel flow rates. Each fuel injector 56 may be mechanically, electrically, pneumatically, or hydraulically operated.

Exhaust system 24 may be configured to direct exhaust from cylinder 28 to the atmosphere and may include an exhaust manifold 58 in fluid communication with exhaust passageway 44 associated with each cylinder 28. It is contemplated that exhaust system 24 may include other components such as, for example, a turbine, an exhaust gas recirculation system, a particulate filter, a catalytic after-treatment device, or any other exhaust system component known in the art.

Control system 26 may include components that cooperate to regulate the operation of fuel injector 56. In particular, control system 26 may sense one or more operational characteristics of internal combustion engine 10 and affect operation of fuel injectors 56 in response to the sensed operational characteristics. Control system 26 may include an ambient air pressure sensor 60, an inlet manifold air pressure (IMAP) sensor 62, an engine speed sensor 64, and an engine control unit (ECU) 66. ECU 66 may be in communication with ambient air pressure sensor 60, with IMAP sensor 62, with engine speed sensor 64, and with fuel injectors 56 via communication lines 67, 68, 70, and 72, respectively. It is contemplated that ECU 66 may be in communication with additional components and systems of internal combustion engine 10 and/or work machine 5 to receive other fuel system-related input.

Ambient air pressure sensor 60 may be mounted to a member of work machine 5 or internal combustion engine 10 and configured to sense the ambient air pressure. In particular, ambient air pressure sensor 60 may embody a strain gauge-type sensor, a piezoresistive type pressure sensor, or any other type of pressure sensing device known in the art. Ambient air pressure sensor 60 may generate a signal indicative of the ambient air pressure and send this signal to ECU 66 via communication line 67. This signal may be sent continuously, on a periodic basis, or only when prompted by ECU 66.

IMAP sensor 62 may be mounted at least partially within inlet manifold 52 and configured to sense the absolute pressure of air within inlet manifold 52 (e.g., air entering combustion chamber 38). Similar to ambient air pressure sensor 60, IMAP sensor 62 may embody a strain gauge-type sensor, a piezoresistive type pressure sensor, or any other type of pressure sensing device known in the art. IMAP sensor 62 may generate a signal indicative of the absolute inlet manifold pressure and send this signal to ECU 66 via communication line 68. This IMAP signal may be sent continuously, on a periodic basis, or only when prompted by ECU 66

Engine speed sensor 64 may sense a speed of internal combustion engine 10. For example, engine speed sensor 64 may embody a magnetic pickup sensor configured to sense a rotational speed of crankshaft 34 and to produce a signal corresponding to the rotational speed. Engine speed sensor 64 may be disposed proximal a magnetic element (not shown) embedded within crankshaft 34, proximal a magnetic element (not shown) embedded within a component directly or indirectly driven by crankshaft 34, or in other suitable manner to produce a signal corresponding to the rotational speed of internal combustion engine 10

ECU 66 may embody a single microprocessor or multiple microprocessors that include a means for controlling an operation of fuel system 22. Numerous commercially available microprocessors can be configured to perform the functions of ECU 66. It should be appreciated that ECU 66 could readily be embodied in a general work machine microprocessor capable of controlling numerous work machine functions. ECU 66 may include a memory, a secondary storage device, a processor, and any other components for running an application. Various other circuits may be associated with ECU 66 such as power supply circuitry, signal conditioning circuitry, solenoid driver circuitry, and other types of circuitry.

ECU 66 may regulate the amount of each fuel injection based on the signals from ambient air pressure sensor 60, IMAP sensor 62, and engine speed sensor 64. Specifically, a plurality of maps relating the IMAP signal, the engine speed signal, and fuel limit values may be stored in the memory of ECU 66. Each of these maps may include a collection of data in the form of tables, graphs, and/or equations. For example, the IMAP signal, engine speed signal, and fuel limit may form the coordinate axis of a 3-D graph. Each of these maps may correspond with different predetermined air pressure values and/or associated altitudes. That is, a first map stored within ECU 66 may correspond with a first air pressure value such as the standard air pressure value associated with sea level. A second map stored within ECU 66 may correspond with a second air pressure value such as the standard air pressure value associated with a maximum engine-rated altitude above sea level. Similarly, additional maps could be stored within ECU 66 that correspond to differing air pressure values associated with differing altitudes between sea level and the maximum engine-rated altitude.

The fuel limit values determined from each of the maps stored within the memory of ECU 66 for a given inlet manifold air pressure and given engine speed may be non-linear to accommodate a relaxing of emission regulations that occurs as the operational altitude of internal combustion engine 10 increases. In particular, current U.S. emission regulations relax according to altitude as a means of protecting internal combustion engine 10 from overheating, from overspeeding of turbochargers associated with internal combustion engine 10, and/or from other potential damage to internal combustion engine 10. The relationship maps stored within ECU 66 may reflect this relaxing by having a first trend between the fuel limits of maps associated with altitudes lower than 5,500 ft, and a second trend between the fuel limits of maps associated with altitudes greater than 5,500 ft. The composite trend of all of the maps within the memory of ECU 66 may be non-linear to reflect the relaxing of emission regulations.

Figure 3:
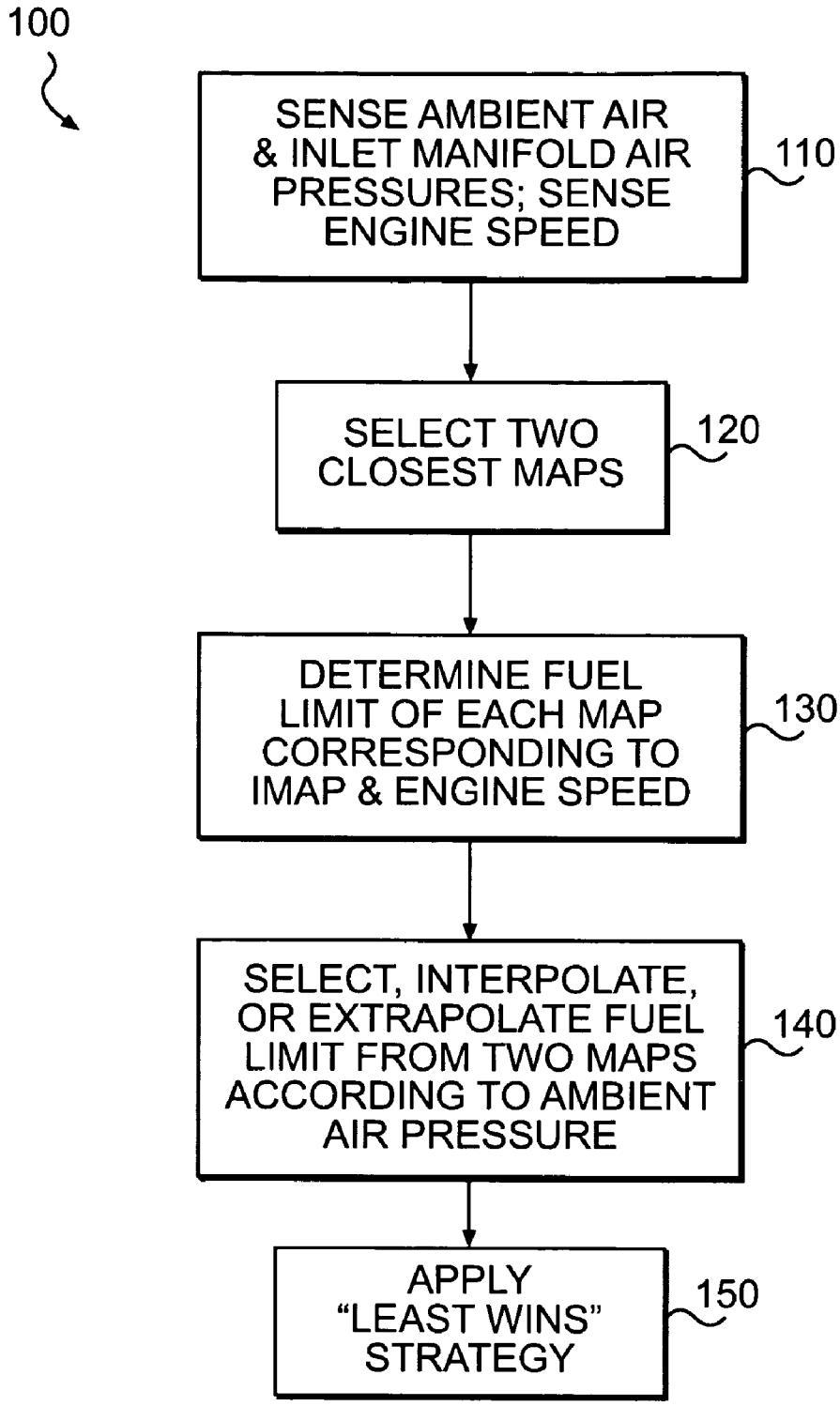
FIG. 3 is a flow chart depicting an exemplary disclosed method of operating the internal combustion engine of FIG. 2.

During operation of internal combustion engine 10, ECU 66 may limit the maximum fuel injected per stroke of piston assembly 14 according to the signals from ambient air pressure sensor 60, IMAP sensor 62, engine speed sensor 64, and the relationship maps described above. FIG. 3 illustrates a flowchart 100 depicting an exemplary method of regulating the operation of fuel system 22 by using these relationship maps. Flowchart 100 will be described in further detail in the following section.

INDUSTRIAL APPLICABILITY

The disclosed fuel control system may be applicable to any internal combustion engine where the regulation of exhaust emissions from the engine during operation at varying altitudes is necessary. The operation of internal combustion engine 10 will now be explained.

During an intake stroke of internal combustion engine 10, as piston assembly 14 is moving within cylinder 28 between the TDC position and the BDC position, intake valve 48 may be in the open position, as shown in FIG. 1. During the intake stroke, the downward movement of piston assembly 14 toward the BDC position may create a low pressure within cylinder 28. This low pressure may act to draw air from intake passageway 40 into cylinder 28 via intake port 42. As described above, a turbocharger may alternatively be used to force compressed air into cylinder 28.

Following the intake stroke, both intake valve 48 and exhaust valve 50 may be in a closed position where the air is blocked from exiting cylinder 28 during the upward compression stroke of piston assembly 14. As piston assembly 14 moves upward from the BDC position toward the TDC position during the compression stroke, fuel may be injected into cylinder 28 for mixing and compression with air within cylinder 28. It is contemplated that the fuel may be injected into cylinder 28 at any time during the compression stroke, during a portion of the intake stroke when operating as a Homogeneous Charge Compression Ignition engine, or at multiple times during both the intake and compression strokes when operating as a Mixed Mode Injection engine.

The amount of fuel injected into combustion chamber 38 relative to the amount of air drawn or forced into combustion chamber 38 may affect the amount of particulate matter or black smoke generated by and exhausted from internal combustion engine 10. As described above, a higher fuel to air equivalence ratio during combustion within internal combustion engine 10 will result in a greater production of black smoke, while a lower fuel to air equivalence ratio will result in a lower production of black smoke. In order to provide consistently compliant fuel to air equivalent ratios within combustion chamber 38 during operation of internal combustion engine 10 at varying altitudes, it may be necessary for ECU 66 to limit the maximum amount of fuel injected into combustion chamber 38 during any one cycle of piston assembly 14.

Flowchart 100 of FIG. 3 illustrates an exemplary method of limiting the maximum fuel injection amount. As illustrated in flowchart 100, the first step of providing compliant fuel to air equivalence ratios within combustion chamber 38 may begin by sensing the ambient air pressure, sensing the IMAP, and sensing the rotational speed of internal combustion engine 10 (Step 110).

Once the ambient pressure has been sensed, two maps from within the memory of ECU 66 may be selected for use in determining the fuel limitation values (Step 120). The two maps selected for this use may be the two maps within the memory of ECU 66 having corresponding air pressure values closest to the sensed ambient air pressure. Within each of these two maps, a fuel limit value may be selected, interpolated, or extrapolated that corresponds to the sensed IMAP and engine speed (Step 130). Following step 130, the two selected, interpolated, or extrapolated fuel limit values may be used to select, interpolate, or extrapolate a third fuel limit value corresponding to the sensed ambient air pressure (Step 140).

ECU 66 may apply a "least wins" strategy when limiting the injection of fuel into combustion chamber 38. That is, ECU 66 may compare the third fuel limit value determined during step 140 described above to other fuel limiting values calculated through various different control algorithms associated with internal combustion engine 10 and apply the lowest of the fuel limit values (Step 150). For example, if an operator-desired fuel setting is lower than the fuel limit value determined in step 140, the fuel limit signal sent to fuel injectors 56 may correspond with the operator-desired fuel setting. Likewise, if the fuel limit value determined in step 140 is less than a maximum torque fuel setting, the signal sent to fuel injectors 56 may correspond with the fuel limit value determined in step 140.

Many advantages may be associated with the disclosed control system over the prior art. In particular, because the operation of internal combustion engine 10 at varying altitudes may be affected differently according to engine speed, the production of black smoke may be accurately controlled throughout the operational range of internal combustion engine 10. For this same reason, efficient operation of internal combustion engine may be maintained throughout the operational range of internal combustion engine 10 by only limiting fuel introduction as absolutely necessary. In addition, because altitude operation of internal combustion engine 10 may be affected by multiple maps corresponding to different predetermined altitudes, the fuel-limiting trends contained within the maps and applied to the operation of internal combustion engine 10 may be custom tailored to meet emission regulations. These custom tailored fuel-limiting trends may improve the efficiency and response of internal combustion engine 10, as well as extending the life of internal combustion engine 10.

It will be apparent to those skilled in the art that various modifications and variations can be made to the disclosed control system. Other embodiments will be apparent to those skilled in the art from consideration of the specification and practice of the disclosed control system. It is intended that the specification and examples be considered as exemplary only, with a true scope being indicated by the following claims and their equivalents.

What is claimed is:

1. A control system for an engine having a combustion chamber, comprising:

a first sensor configured to generate a signal indicative of ambient air pressure;

a second sensor configured to generate a signal indicative of the pressure of air entering the combustion chamber;

a third sensor configured to generate a signal indicative of a speed of the engine; and a controller in communication with the first, second, and third sensors, the controller configured to:

reference a first map stored in a memory of the controller to determine a first fuel limit value based on the pressure of air entering the combustion chamber and the speed of the engine;

reference a second map stored in a memory of the controller to determine a second fuel limit value based on the pressure of air entering the combustion chamber and the speed of the engine; and determine a third fuel limit value based on the first and second fuel limit values and the ambient air pressure.

2. The control system of claim 1, wherein the controller is in communication with the engine and configured to limit the amount of fuel introduced to the engine during a single cycle of the engine to the third fuel limit value.

3. The control system of claim 1, wherein the controller is configured to compare the third fuel limit value to a torque limit fuel value and to limit the amount of fuel introduced to the engine during a single cycle of the engine to the lower of the third fuel limit value and the torque limit fuel value.

4. The control system of claim 1, wherein each of the first and second maps corresponds to different predetermined ambient air pressures.

5. The control system of claim 4, wherein the memory of the controller stores at least three maps, the first and second maps having corresponding predetermined ambient air pressures closer to the sensed ambient air pressure than the corresponding predetermined ambient air pressure of the remaining of the at least three maps.

6. The control system of claim 5, wherein:

one of the at least three maps corresponds with the ambient air pressure at sea level; and one of the at least three maps corresponds with the ambient air pressure at the highest rated altitude of the engine.

7. The control system of claim 6, wherein:

one of the at least three maps corresponds with the ambient air pressure at an altitude between sea level and the highest rated altitude; and the fuel limit values determined from the at least three maps for a given pressure of air entering the combustion chamber and a given engine speed are non-linear.

8. The control system of claim 1, wherein the signal from the second sensor indicates an absolute air pressure.

9. A method of controlling an engine having a combustion chamber, comprising:

sensing an ambient air pressure;

sensing a pressure of air entering the combustion chamber;

sensing a speed of the engine;

determining a first fuel limit value based on the pressure of air entering the combustion chamber and the speed of the engine;

determining a second fuel limit value based on the pressure of air entering the combustion chamber and the speed of the engine; and determining a third fuel limit value based on the first and second fuel limit values and the ambient air pressure.

10. The method of claim 9, further including limiting the amount of fuel introduced to the engine during a single cycle of the engine to the third fuel limit value.

11. The method of claim 9, further including:

comparing the third fuel limit value to a torque limit fuel value; and limiting the amount of fuel introduced to the engine during a single cycle of the engine to the lower of the third fuel limit value and the torque limit fuel value.

12. The method of claim 9, wherein determining the first and second fuel limit values includes referencing a plurality of maps stored in a memory of a controller, each of the plurality of maps corresponding to different predetermined ambient air pressures.

13. The method of claim 12, wherein the method further includes:

comparing the corresponding predetermined ambient air pressures of each of the plurality of maps to the sensed ambient air pressure; and selecting a first map and a second map from the plurality of maps for referencing when the corresponding predetermined ambient air pressures of the first and second maps are closer to the sensed ambient air pressure than the corresponding predetermined ambient air pressure of the remaining of the plurality of maps.

14. The method of claim 13, wherein:

one of the plurality of maps corresponds with the ambient air pressure at sea level;

one of the plurality of maps corresponds with the ambient air pressure at the highest rated altitude for the engine;

one of the plurality of maps corresponds with the ambient air pressure at an altitude between sea level and the highest rated altitude; and the fuel limit values determined from the plurality of maps for a given pressure of air entering the combustion chamber and a given engine speed are non-linear.

15. An engine, comprising:

an engine block defining a plurality of cylinders;

a plurality of piston assemblies disposed within the plurality of cylinders to form a plurality of combustion chambers;

a fuel system configured to selectively introduce fuel into the plurality of combustion chambers during a stroke of the plurality of piston assemblies; and a control system configured to limit the maximum amount of fuel introduced into the plurality of combustion chambers during a single cycle of the engine, the control system including:

a first sensor configured to generate a signal indicative of ambient air pressure;

a second sensor configured to generate a signal indicative of the pressure of air entering the combustion chamber;

a third sensor configured to generate a signal indicative of a speed of the engine; and a controller in communication with the first, second, and third sensors, the controller configured to:

reference a first map stored in a memory of the controller to determine a first fuel limit value based on the pressure of air entering the combustion chamber and the speed of the engine;

reference a second map stored in a memory of the controller to determine a second fuel limit value based on the pressure of air entering the combustion chamber and the speed of the engine; and determine a third fuel limit value based on the first and second fuel limit values and the ambient air pressure.

16. The engine of claim 15, wherein the controller is configured to compare the third fuel limit value to a torque limit fuel value and to limit the amount of fuel introduced to the engine during a single cycle of the engine to the lower of the third fuel limit value and the torque limit fuel value.

17. The engine of claim 15, wherein each of the first and second maps corresponds to different predetermined ambient air pressures.

18. The engine of claim 17, wherein the memory of the controller stores at least three maps, the first and second maps having corresponding predetermined ambient air pressures closer to the sensed ambient air pressure than the corresponding predetermined ambient air pressure of the remaining of the at least three maps.

19. The engine of claim 18, wherein:

one of the at least three maps corresponds with the ambient air pressure at sea level;

one of the at least three maps corresponds with the ambient air pressure at the highest rated altitude of the engine;

one of the at least three maps corresponds with the ambient air pressure at an altitude between sea level and the highest rated altitude; and the fuel limit values determined from the at least three maps for a given pressure of air entering the combustion chamber and a given engine speed are non-linear.

20. The engine of claim 15, wherein the signal from the second sensor indicates an absolute air pressure.

* * * * *